US009141126B2

(12) United States Patent
Hynes et al.

(10) Patent No.: US 9,141,126 B2
(45) Date of Patent: Sep. 22, 2015

(54) HYDRAULIC APPARATUS RETURN TO NEUTRAL MECHANISM

(71) Applicant: Parker-Hannifin Corporation, Cleveland, OH (US)

(72) Inventors: Richard C. Hynes, Chuckey, TN (US); Jason Scot Richardson, Chuckey, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 273 days.

(21) Appl. No.: 13/712,365

(22) Filed: Dec. 12, 2012

(65) Prior Publication Data

US 2013/0145890 A1 Jun. 13, 2013

Related U.S. Application Data

(60) Provisional application No. 61/569,427, filed on Dec. 12, 2011.

(51) Int. Cl.

| | |
|---|---|
| ***F04B 1/32*** | (2006.01) |
| ***G05G 1/01*** | (2008.04) |
| ***F04B 49/12*** | (2006.01) |

(52) U.S. Cl.

CPC .. *G05G 1/01* (2013.01); *F04B 1/32* (2013.01); *F04B 1/324* (2013.01); *F04B 49/12* (2013.01); *Y10T 74/2036* (2015.01)

(58) Field of Classification Search

CPC ..... F04B 49/12; F04B 1/324; F04B 1/32; G05G 1/01

USPC ..... 74/96, 97.1; 60/487; 92/12.2; 267/150, 267/178, 182

See application file for complete search history.

(56) References Cited

U.S. PATENT DOCUMENTS

| | | | | |
|---|---|---|---|---|
| 4,111,062 | A | 9/1978 | Callaghan | |
| 4,955,249 | A | 9/1990 | Wetor | |
| 6,536,299 | B2 * | 3/2003 | Kim | 74/473.18 |
| 6,782,797 | B1 | 8/2004 | Brandenburg et al. | |
| 6,829,979 | B1 | 12/2004 | Thomas | |
| 7,111,545 | B1 | 9/2006 | Langenfeld | |
| 7,131,267 | B1 * | 11/2006 | Keller et al. | 60/399 |
| 7,197,873 | B1 | 4/2007 | Windhorst et al. | |
| 7,234,385 | B2 * | 6/2007 | Dong et al. | 92/12.2 |
| 7,340,890 | B1 * | 3/2008 | Poplawski et al. | 60/487 |
| 7,458,311 | B2 | 12/2008 | Korthals | |
| 7,703,376 | B2 * | 4/2010 | Mish et al. | 92/12.2 |

FOREIGN PATENT DOCUMENTS

WO 2008/028007 A1 3/2008

* cited by examiner

*Primary Examiner* — William Kelleher
*Assistant Examiner* — Thomas Magnuson
(74) *Attorney, Agent, or Firm* — Renner, Otto, Boisselle & Sklar, LLP

(57) ABSTRACT

A return to neutral mechanism is provided for hydraulic apparatuses such as motors/pumps that utilize a swashplate and a trunnion arm to control flow. The return to neutral mechanism includes two rotating brackets which have ends aligned to a single plane. Two springs are utilized and attached to the ends of the two rotating brackets giving the force mechanism the ability apply the force in a direct path, reducing friction, increasing life, and improving accuracy. This design is an "x" type mechanism, the force arms are in-line and do not cross, the force is applied equally on both sides of the fulcrum and therefore balanced. The mechanism can be can be used with compression springs, tension springs, torsion springs, or leaf springs.

20 Claims, 5 Drawing Sheets

HYDRAULIC APPARATUS RETURN TO NEUTRAL MECHANISM

CROSS REFERENCE TO RELATED APPLICATIONS

This application claims the benefit of the filing date of U.S. Provisional Patent Application Ser. No. 61/569,427, filed Dec. 12, 2011, the disclosure of which is incorporated herein by reference in its entirety.

FIELD OF THE INVENTION

The invention herein described relates generally to a hydraulic apparatus with return to neutral mechanism that utilizes two springs applying a balanced force to a trunnion arm to return it to a neutral position.

BACKGROUND

Many hydraulic apparatuses, such as pumps or motors, include a device that is rotatable for varying the displacement of the apparatus. For example, on a hydraulic pump, such as an axial piston pump, a swash plate is connected to a trunnion arm that is rotatable for varying the displacement of the pump. More specifically, rotation of the trunnion arm rotates the swash plate to vary the displacement of a pumping unit of the hydraulic pump. When the swash plate is in a predetermined location, there is no displacement from the hydraulic pump. The position of the trunnion arm associated with this predetermined location of the swash plate is commonly referred to as the neutral position. Thus, when the trunnion arm is in the neutral position, there is no fluid displacement from the hydraulic pump. When the trunnion arm is rotated in a first direction from the neutral position, the swash plate rotates away from the predetermined location in a first direction and hydraulic fluid flows out of a first system port of the pump. Similarly, when the trunnion arm is rotated in a second direction, opposite the first direction, the swash plate is rotated away from the predetermined location in a second direction, opposite the first direction, and hydraulic fluid flows out of a second system port of the pump.

Mechanisms are associated with such hydraulic apparatuses for acting upon the trunnion to bias the trunnion into the neutral position. One such mechanism is shown in U.S. Pat. No. 6,968,687, hereby incorporated by reference.

SUMMARY

At least one embodiment of the invention provides a hydraulic apparatus comprising: a housing; a trunnion arm extending from the housing; a first bracket rotatably coupled to the trunnion arm and having a drive member; a second bracket attached to the housing and having a stop member; a third bracket rotatable about the trunnion arm having a central aperture through which the trunnion arm extends, the first bracket having a first end and a second end; a fourth bracket rotatable about the trunnion arm having a central aperture through which the trunnion arm extends, the second bracket having a first end and a second end; a first spring having a first end attached to a first end of the third bracket and a second end attached to a first end of the fourth bracket; a second spring having a first end attached to a second end of the third bracket and a second end attached to a second end of the fourth bracket; wherein the springs bias the first end of the third bracket and the first end of the fourth bracket toward the stop member of the second bracket and bias the first bracket toward a neutral position.

At least one embodiment of the invention provides a return to neutral mechanism for a hydraulic apparatus including a housing and a trunnion arm extending from the housing, the return to neutral assembly comprising: a first bracket arm rotatably coupled to the trunnion arm and having a drive member; a second bracket arm attached to the housing and having a stop member; a third bracket rotatable about the trunnion arm having a central aperture through which the trunnion arm extends; a fourth bracket rotatable about the trunnion arm having a central aperture through which the trunnion arm extends; a first spring having a first end attached to a first end of the third bracket and a second end attached to a first end of the fourth bracket; a second spring having a first end attached to a second end of the third bracket and a second end attached to a second end of the fourth bracket; wherein the springs bias the first bracket arm toward a neutral position.

At least one embodiment of the invention provides a return to neutral mechanism for a hydraulic apparatus including a housing and a trunnion arm extending from the housing, the return to neutral assembly comprising: a first bracket arm rotatably coupled to the trunnion arm and having a drive member; a stop member attached to the housing; a second bracket rotatable about the trunnion arm having a central aperture through which the trunnion arm extends; a third bracket rotatable about the trunnion arm having a central aperture through which the trunnion arm extends; a first spring having a first end attached to a first end of the second bracket and a second end attached to a first end of the third bracket; a second spring having a first end attached to a second end of the second bracket and a second end attached to a second end of the third bracket; wherein the springs bias the first bracket arm toward a neutral position.

BRIEF DESCRIPTION OF THE DRAWINGS

Embodiments of this invention will now be described in further detail with reference to the accompanying drawings, in which:

FIG. 1 is a perspective view of a prior art hydraulic unit of the type that the return to neutral mechanism of the present invention is used on;

DETAILED DESCRIPTION OF THE DRAWINGS

Figure 1:
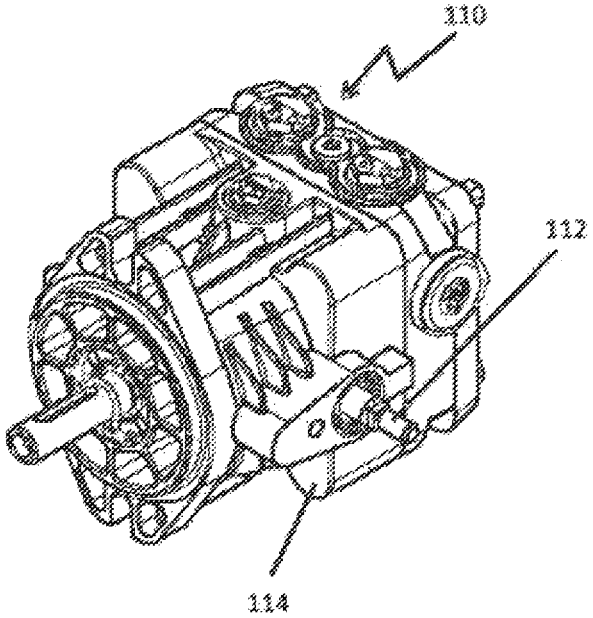
Figure 2:
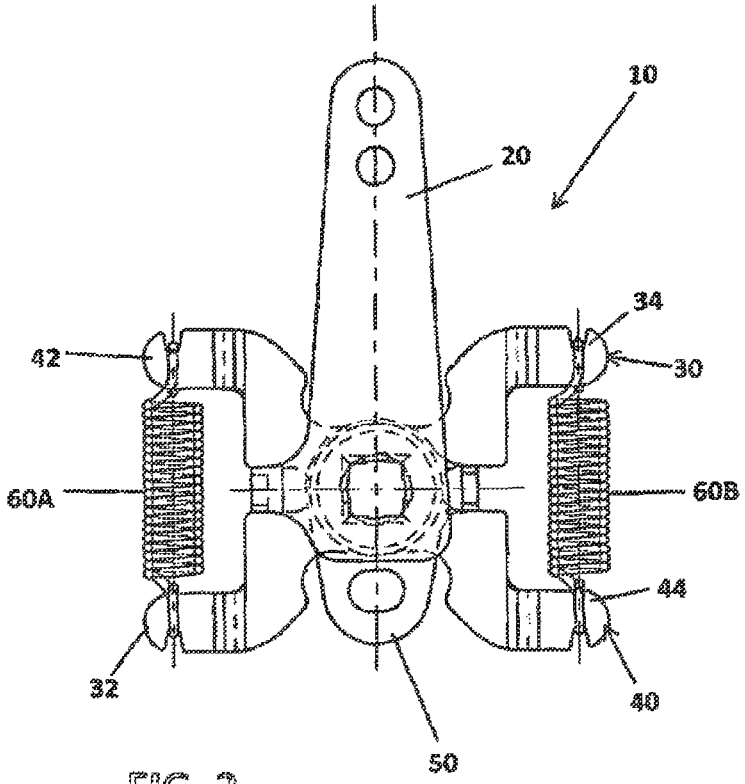
FIG. 2 is a plan view of a return to neutral mechanism in accordance with an embodiment of the present invention shown in a neutral position.

The present invention is directed toward a return to neutral mechanism 10 for use with a hydraulic apparatus such as an axial piston pump 110 shown in FIG. 1 of the type including a rotating group (not shown) and an associated swash plate (not shown). A trunnion arm 112 is associated with the swash plate and controls rotation of the swash plate. The return to neutral mechanism 10 is attachable to a housing 114 of the pump 110 and acts to bias the trunnion arm 112 into a neutral position in which displacement of the pump 110 is zero. Referring now to FIGS. 2-5, the return to neutral mechanism 10 includes a first rotatable bracket 20 fixably attached to the trunnion arm and rotatable with the trunnion arm, a second stationary bracket 50 fixed to the housing, and a third rotatable bracket 30 and a fourth rotatable bracket 40. The third and fourth brackets 30, 40 are secured to the trunnion arm in a slip fit manner. The trunnion arm extends through the brackets which are secured to the trunnion arm by a fastener (not shown) and the elements are spaced from each other by washers 70 as shown. The first rotatable bracket 20 includes an extension portion or drive member 22 shown extending generally perpendicular to the remainder of the first rotating bracket 20. The drive member 22 moves either the third bracket 30 or the fourth bracket 40 when the first bracket 20 rotates from the neutral position with the trunnion. The second stationary bracket 50 includes an extension portion or stop member 52 shown extending generally perpendicular to the remainder of the second stationary bracket 20. The return to neutral mechanism 10 includes a first biasing means shown as a tension spring 60A. Spring 60A is attached to a first end 32 of the third bracket 30 and a first end 42 of the fourth bracket 40 and biases them toward a stop member 52. A second tension spring 60B is attached to a second end 34 of the third bracket 30 and a second end 44 of the fourth bracket 40 and biases them against movement of the drive member 22 of the first rotatable bracket 20 and to return the drive member 22 to a neutral position. The first spring 60A is positioned to span the stop member 52 of the second bracket 50 and the second spring 60B is positioned to span the drive member 22 of the first bracket 20. As shown, the first spring 60A and the second spring 60B are generally positioned parallel to each other.

Figure 3:
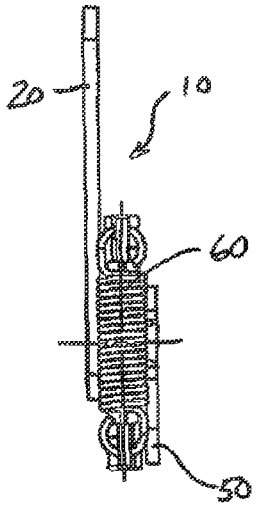
FIG. 3 is a side view of the return to neutral mechanism of FIG. 2.
Figure 4:
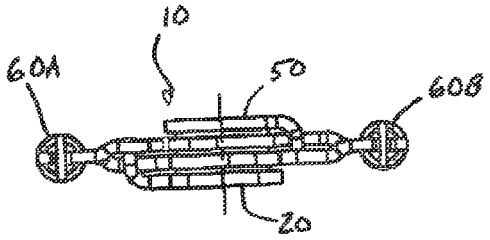
FIG. 4 is a top view of the return to neutral mechanism of FIG. 2.
Figure 5:
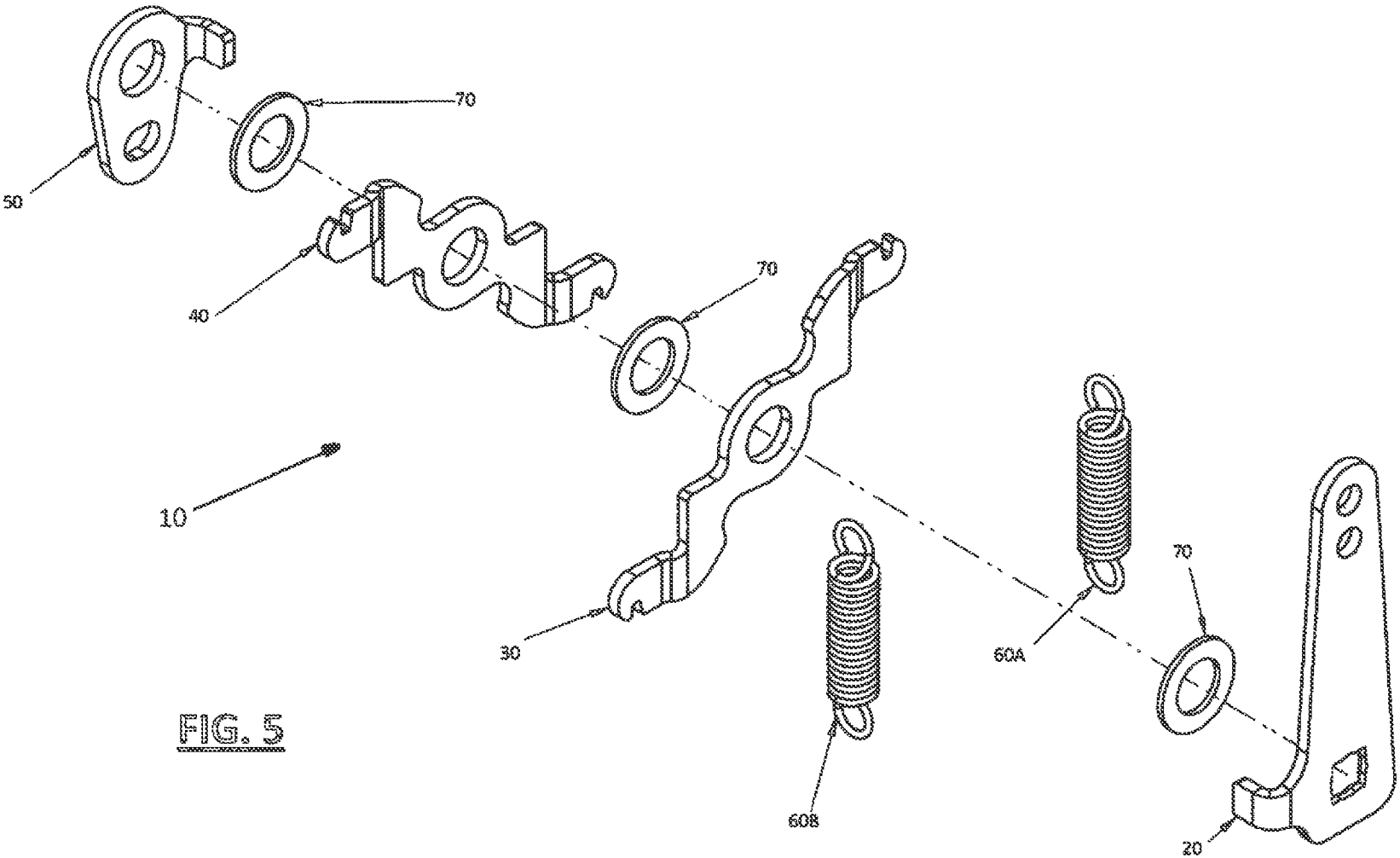
FIG. 5 is an exploded perspective view of the return to neutral mechanism of FIG. 2.

Referring now to FIGS. 3 and 4, the first and second ends of the third bracket 30 and the fourth bracket 40 are generally positioned in the same plane. This enables the attached springs 60A, 60B to be attached to the brackets in a single plane, enabling the springs 60A, 60B to apply the force in a direct path, reducing friction, increasing life, and improving accuracy of the return to neutral mechanism 10.

Figure 6:
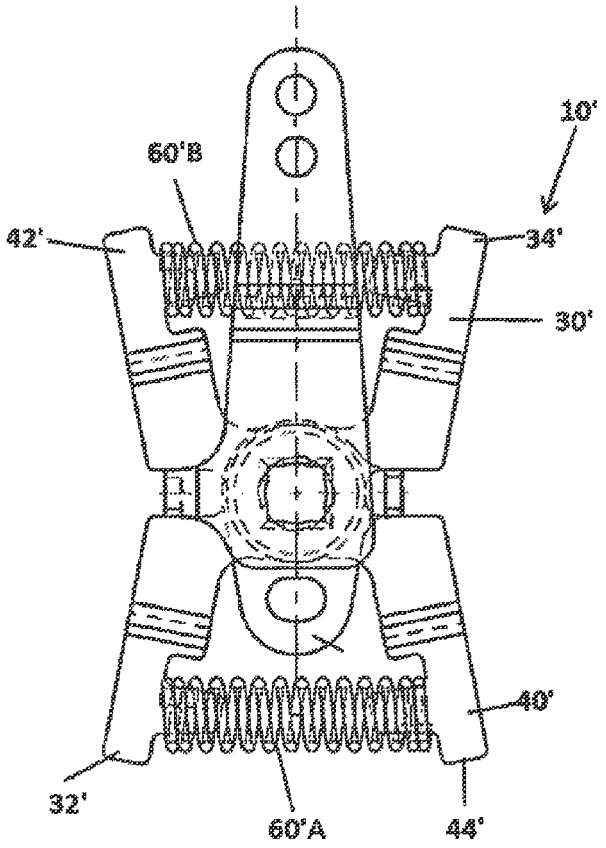
FIG. 6 is a plan view of a return to neutral mechanism in accordance with another embodiment of the present invention shown in a neutral position.
Figure 7:
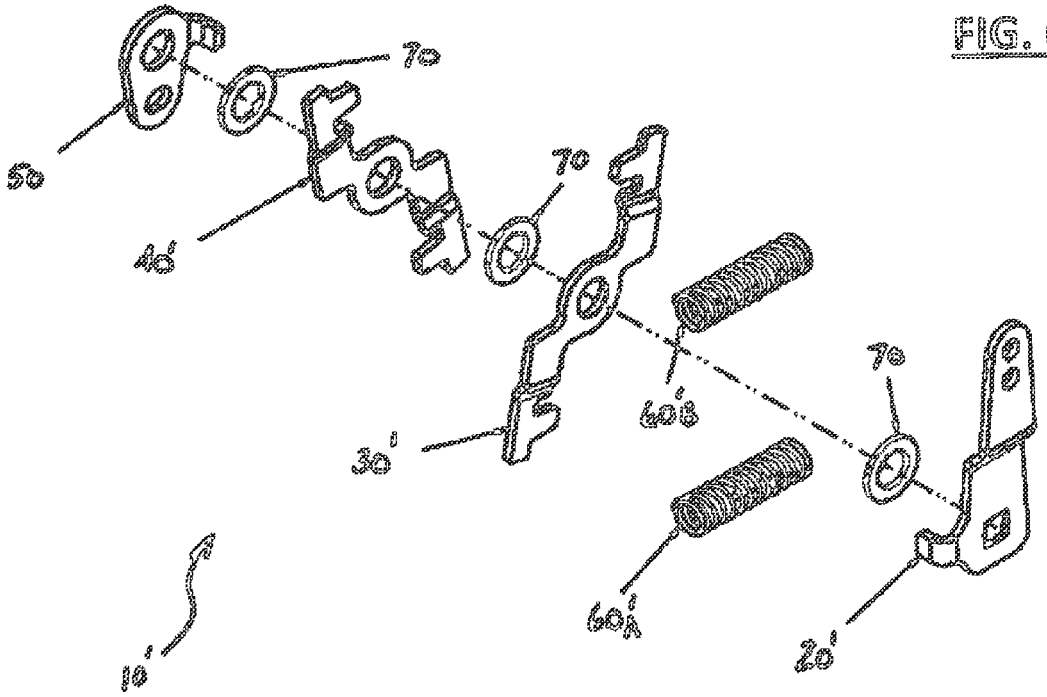
FIG. 7 is an exploded perspective view of the return to neutral mechanism of FIG. 6.

FIGS. 6 and 7 show an alternate embodiment of the return to neutral mechanism 10'. The return to neutral mechanism 10' comprises compression springs 60A' and 60B'. The spring 60A' extends from a first end 32' of the third bracket 30' to a second end 44' of the fourth bracket 40'. The spring 60B' extends from a second end 34' of the third bracket 30' to a first end 42' of the fourth bracket 40'. The springs 60A', 60B' bias the first rotatable bracket 20 into the neutral position.

Figure 8:
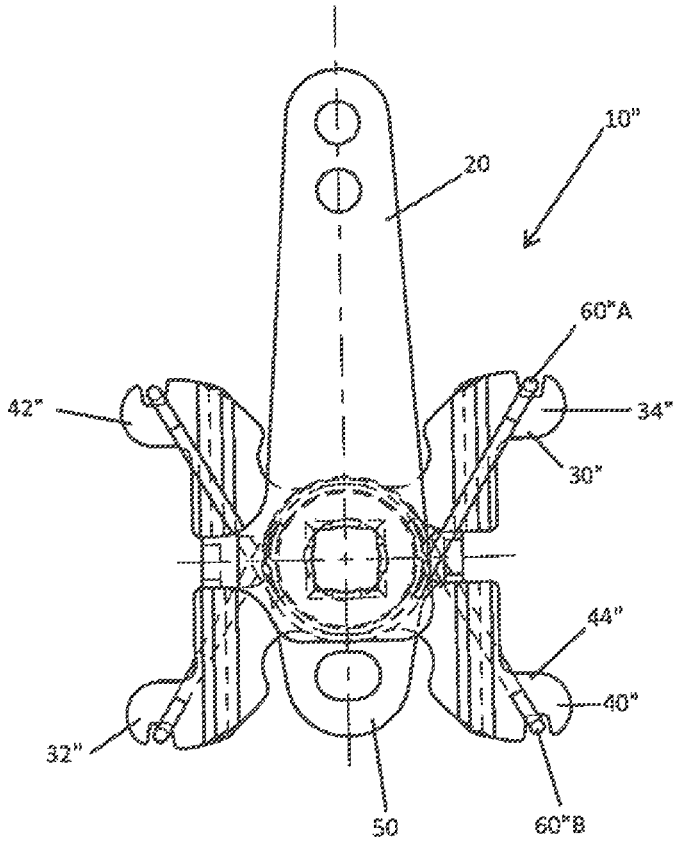
FIG. 8 is a plan view of a return to neutral mechanism in accordance with yet another embodiment of the present invention shown in a neutral position.
Figure 9:
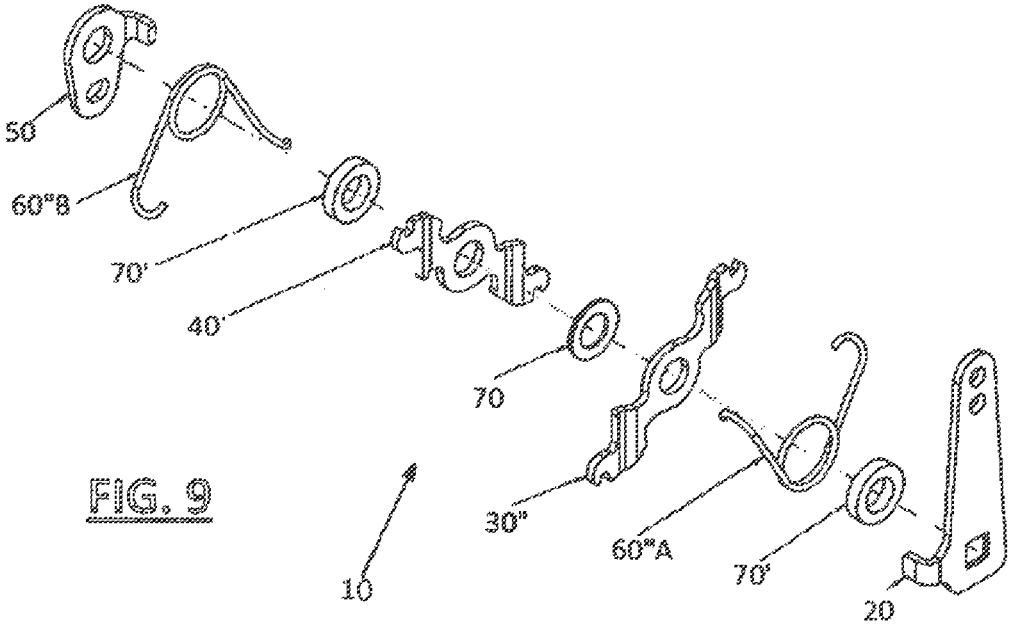
FIG. 9 is an exploded perspective view of the return to neutral mechanism of FIG. 8.

FIGS. 8 and 9 show another alternate embodiment of the return to neutral mechanism 10". The return to neutral mechanism 10" comprises torsion springs 60A" and 60B". The spring 60A" extends from a second end 34" of the third bracket 30" to a first end 42" of the fourth bracket 40". The spring 60B" extends from a first end 32" of the third bracket 30" to a second end 44" of the fourth bracket 40". The springs 60A", 60B" bias the first rotatable bracket 20 into the neutral position.

Other return to neutral mechanisms utilize a single spring to create the return force which can create a side load on the rotable arm(s) and shaft. The return to neutral mechanism 10, 10', 10" of the present invention uses two springs 60A, 60B which act together to resist the trunnion arm rotation regardless of the direction of rotation. Using the force of both springs reduces the overall load on each spring and allows the use of lower rate springs.

Other designs utilize a "scissor" mechanism, being loaded by a spring on one side and having the work force applied opposite the application force. The return to neutral mechanism 10, 10', 10" of the present invention is an "x" type mechanism, the force arms are in-line and do not cross, the force is applied equally on both sides of the fulcrum and therefore balanced. Also, because the area available to mount the springs is similar in size to a single spring design, the springs can be designed with more coils and smaller wire to reduce the overall spring rate. This lowers the required force at the input lever at a full stroke position while still providing the necessary force at lower trunnion angles to return the lever to the neutral (stop) position.

Another advantage to the design is that it can be used with compression springs, tension springs, torsion springs, or leaf springs. This helps when working around various space constraints, tailoring the return force rate to specific customer needs, and providing lower cost options when needed.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention. Accordingly, the scope and content of the present invention are to be defined only by the terms of the appended claims.

What is claimed is:

1. A hydraulic apparatus comprising:

a housing;

a trunnion arm extending from the housing;

a first bracket rotatably coupled to the trunnion arm and having a drive member;

a second bracket attached to the housing and having a stop member;

a third bracket rotatable about the trunnion arm having a central aperture through which the trunnion arm extends, the first bracket having a first end and a second end;

a fourth bracket rotatable about the trunnion arm having a central aperture through which the trunnion arm extends, the second bracket having a first end and a second end;

a first spring having a first end attached to a first end of the third bracket and a second end attached to a first end of the fourth bracket;

a second spring having a first end attached to a second end of the third bracket and a second end attached to a second end of the fourth bracket;

wherein the springs bias the first end of the third bracket and the first end of the fourth bracket toward the stop member of the second bracket and bias the first bracket toward a neutral position.

2. The hydraulic apparatus of claim 1, the third bracket and the fourth bracket each having a first portion adapted to engage the bracket arm drive member and a second portion adapted to engage the stop member of the second bracket.

3. The hydraulic apparatus of claim 1, wherein the first and second springs are tension springs.

4. The hydraulic apparatus of claim 1, wherein the first and second springs are compression springs.

5. The hydraulic apparatus of claim 1, wherein the first and second springs are torsion springs.

6. The hydraulic apparatus of claim 1, wherein movement of the first bracket away from a neutral position is resisted by both the first and second springs.

7. The hydraulic apparatus of claim 1, wherein the first and second ends of the third bracket and the fourth bracket are generally positioned in the same plane.

8. The hydraulic apparatus of claim 1, wherein the first spring is positioned to span the stop member of the second bracket and the second spring is positioned to span the drive member of the first bracket.

9. The hydraulic apparatus of claim 1, wherein the first spring and the second spring are generally positioned parallel to each other.

10. A return to neutral mechanism for a hydraulic apparatus including a housing and a trunnion arm extending from the housing, the return to neutral assembly comprising:

a first bracket rotatably coupled to the trunnion arm and having a drive member;

a second bracket attached to the housing and having a stop member;

a third bracket rotatable about the trunnion arm having a central aperture through which the trunnion arm extends;

a fourth bracket rotatable about the trunnion arm having a central aperture through which the trunnion arm extends;

a first spring having a first end attached to a first end of the third bracket and a second end attached to a first end of the fourth bracket;

a second spring having a first end attached to a second end of the third bracket and a second end attached to a second end of the fourth bracket;

wherein the springs bias the first bracket arm toward a neutral position.

11. The return to neutral mechanism of claim 10, the third bracket and the fourth bracket each having a first portion adapted to engage the drive member of the first bracket and a second portion adapted to engage the stop member of the second bracket.

12. The return to neutral mechanism of claim 10, wherein the first and second springs are tension springs.

13. The return to neutral mechanism of claim 10, wherein the first and second springs are compression springs.

14. The return to neutral mechanism of claim 10, wherein the first and second springs are torsion springs.

15. The return to neutral mechanism of claim 10, wherein movement of the first bracket away from a neutral position is resisted by both the first and second springs.

16. The return to neutral mechanism of claim 10, wherein the first and second ends of the third bracket and the fourth bracket are generally positioned in the same plane.

17. The return to neutral mechanism of claim 10, wherein the first spring is positioned to span the stop member of the second bracket and the second spring is positioned to span the drive member of the first bracket.

18. The return to neutral mechanism of claim 10, wherein the first spring and the second spring are generally positioned parallel to each other.

19. A return to neutral mechanism for a hydraulic apparatus including a housing and a trunnion arm extending from the housing, the return to neutral assembly comprising:

a first bracket arm rotatably coupled to the trunnion arm and having a drive member;

a stop member attached to the housing;

a second bracket rotatable about the trunnion arm having a central aperture through which the trunnion arm extends;

a third bracket rotatable about the trunnion arm having a central aperture through which the trunnion arm extends;

a first spring having a first end attached to a first end of the second bracket and a second end attached to a first end of the third bracket;

a second spring having a first end attached to a second end of the second bracket and a second end attached to a second end of the third bracket;

wherein the springs bias the first bracket arm toward a neutral position.

20. The return to neutral mechanism of claim 19, wherein the first and second springs are generally parallel to each other and movement of the first bracket away from a neutral position is resisted by both the first and second springs in a balanced manner.

* * * * *